US006363680B1

(12) United States Patent
Erwin

(10) Patent No.: US 6,363,680 B1
(45) Date of Patent: Apr. 2, 2002

(54) COMPOSITE POST

(75) Inventor: Ronald D. Erwin, Fayetteville, GA (US)

(73) Assignee: Erwin Industries, Inc., Peachtree City, GA (US)

( * ) Notice: Subject to any disclaimer, the term of this patent is extended or adjusted under 35 U.S.C. 154(b) by 0 days.

(21) Appl. No.: 09/519,543

(22) Filed: Mar. 6, 2000

(51) Int. Cl.[7] ..... E04L 3/30
(52) U.S. Cl. ..... 52/720.2; 52/720.1; 52/736.3
(58) Field of Search ..... 52/720.2, 736.1, 52/720.1, 736.3; 249/143

(56) References Cited

U.S. PATENT DOCUMENTS 3,957,250 A 5/1976 Murphy
4,602,765 A 7/1986 Loper et al.
5,421,556 A 6/1995 Dodge et al.
D420,152 S 2/2000 Erwin
6,240,698 B1 * 6/2001 Chung ..... 52/720.2

FOREIGN PATENT DOCUMENTS

CA 2194258 5/1999

* cited by examiner

*Primary Examiner*—Beth A. Stephan
*Assistant Examiner*—Patrick J. Chavez
(74) *Attorney, Agent, or Firm*—Gardner Groff Mehrman & Josephic, P.C.

(57) ABSTRACT

A spindle or baluster for use in a fence or deck railing which comprises a plastic outer shell having a first end section, a second end section opposite the first end section, and a middle section intermediate the first and second end sections. An elongate wood reinforcing element is positioned within the outer shell and extends from the first end section to the second end section.

12 Claims, 3 Drawing Sheets

COMPOSITE POST

TECHNICAL FIELD

The present invention is directed to building construction products, and in particular to a composite post for such uses such as in porches, decking, and fencing.

BACKGROUND OF THE INVENTION

Outdoor porches, decks, and fences are extremely popular in residential home construction. Homes and apartments, as well as a variety of other buildings, often incorporate exterior porches, decks, and fences into their design. Additionally, porches, decks, and fences are commonly added onto existing structures and landscapes. These structures provide convenient spaces for a variety of outdoor activities, including cookouts, dining and sunbathing, as well as other leisure activities. Wood products have traditionally been the primary source of materials for use in such decking construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long lasting substitute construction materials that can lessen the need to harvest timber resources.

One potential approach to addressing the above need is to provide substitute building products made of plastic, rather than wood. However, because the products must be capable of sustaining certain loads, the replacement products need to be stable and rigid. The material should also be capable of economical manufacture, and be relatively inexpensive. It also needs to be easily fabricated and used in the field.

A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits.

U.S. Pat. No. 3,764,245 describes an apparatus for producing a light structural board of thermoplastic resin.

U.S. Pat. No. 5,253,458 describes a simulated log made from a cast polyvinylchloride (PVC) pipe, selectively filled with a hard cast foam or bead type foam. This patent further describes that the cast PVC pipe is first manufactured and then subsequently filled with the foam filler.

U.S. Pat. No. 5,626,331 of Erwin relates to a composite spindle for use in a fence or deck railing. The composite spindle includes a plastic outer shell having a first end section, a second end section opposite the first end section, and a middle section therebetween. An elongate metal reinforcing element is positioned within the outer shell and extends from the first end section to the second end section. A rigid plastic foam is disposed within at least a portion of the first and second end sections and substantially surrounds portions of the metal reinforcing element.

U.S. Pat. No. 5,862,642 of Erwin relates to a reinforced composite deck post including an elongate, hollow, extruded plastic shell, with the plastic shell being rectangular in cross-section. The plastic shell has an upper end and a lower end and has a notch formed therein adjacent the lower end for receiving a wood joist of a wood deck. The reinforced composite deck post also includes an elongate metal stiffing member positioned within the plastic shell and rigidly secured thereto near the upper end thereof.

SUMMARY OF THE INVENTION

Briefly described, in a preferred form the present invention comprises a post for use in building construction. The post comprises a plastic outer shell having first and second ends and a middle section there between. The composite post further includes a rigid reinforcing member positioned within the plastic outer shell. The rigid reinforcing member extends from the first end to the second end and substantially fills the first and second ends. The first and second ends are rectangular in cross-section and the middle section is bulbous and extends radially outwardly beyond the rectangular first and second ends.

Preferably, the rigid reinforcing member comprises a length of wood snugly fitted within the plastic outer shell and substantially filling the rectangular outer ends of the plastic outer shell.

The middle section of the plastic outer shell can be multi-faceted or it can be curvilinear having a surface of revolution.

The present invention allows for a very strong post. It also allows the post to have the appearance of a large piece of lumber having been turned, but without requiring turning a large piece of wood from one large size to a smaller size. Thus, the present invention conserves precious timber resources.

With this construction, a composite post is provided which is easy to manufacture, which provides excellent appearance, and which provides good strength (both in terms of bending resistance and compression load-carrying capability). The composite post is very weather-resistant owing to its outer cladding protecting the wood within. This composite material represents a good alternative to the use of traditional wood posts.

Accordingly, it is an object of the present invention to provide a composite post which is economical in manufacture and application, durable in construction, and simple.

It is another object of the invention to provide a composite post which has good strength and rigidity for use in fencing and deck railings.

It is yet another object of the present invention to provide a composite post which, while having the general appearance of a traditional wood item, conserves scarce timber resources and is highly resistant to weathering.

These and other objects, advantages, and features of the present invention will become more apparent upon reading the following specification in conjunction with the accompanying drawing figures.

BRIEF DESCRIPTION OF THE DRAWING FIGURES

Figure 3:
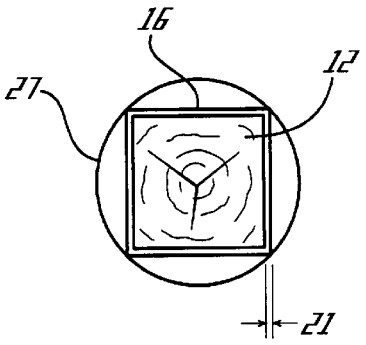
Figure 4:
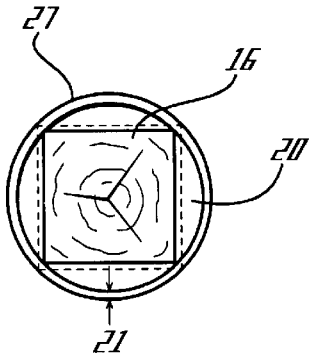
Figure 2:
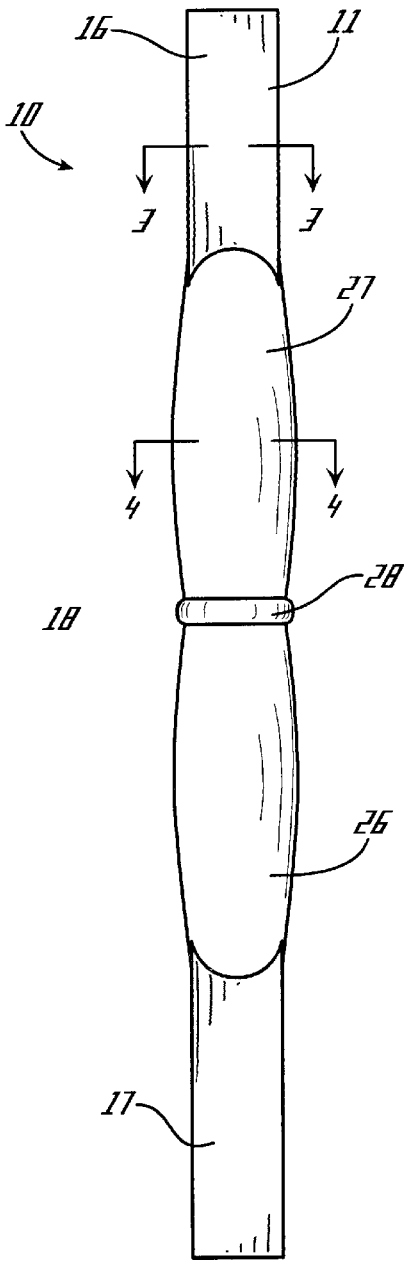
FIG. 2 is a side elevation view of the composite post of FIG. 1.

FIGS. 3 and 4 are sectional views of the composite post of FIG. 2, taken along view lines 3—3 and 4—4, respectively.

Figure 5:
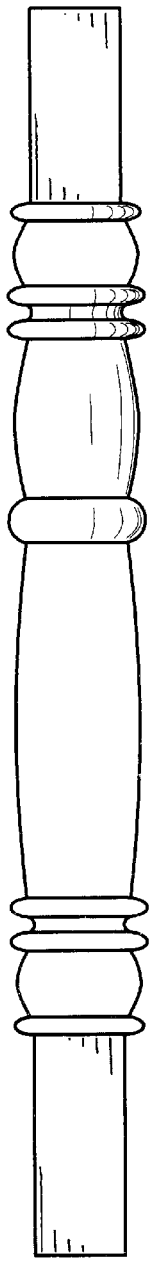

FIG. 5 is a side elevation view of the composite post according to a second form of the invention.

Figure 6:
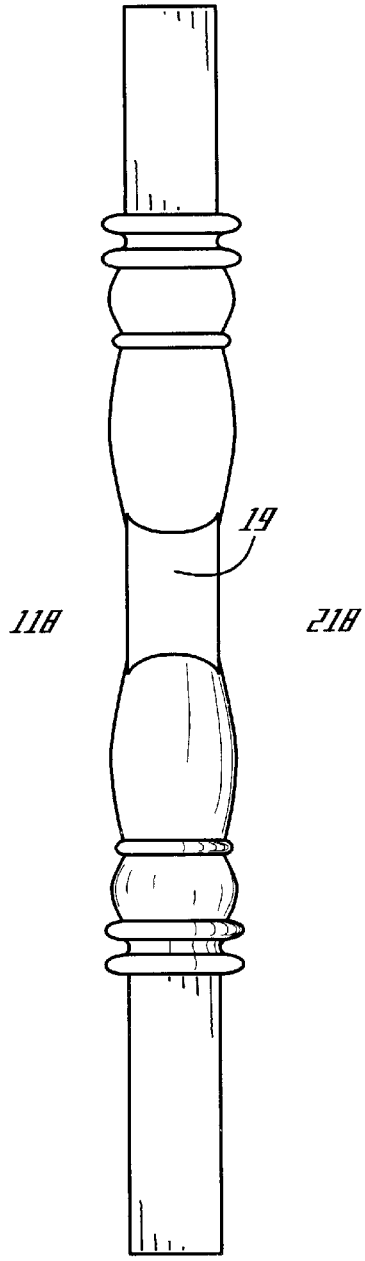
Figure 1:
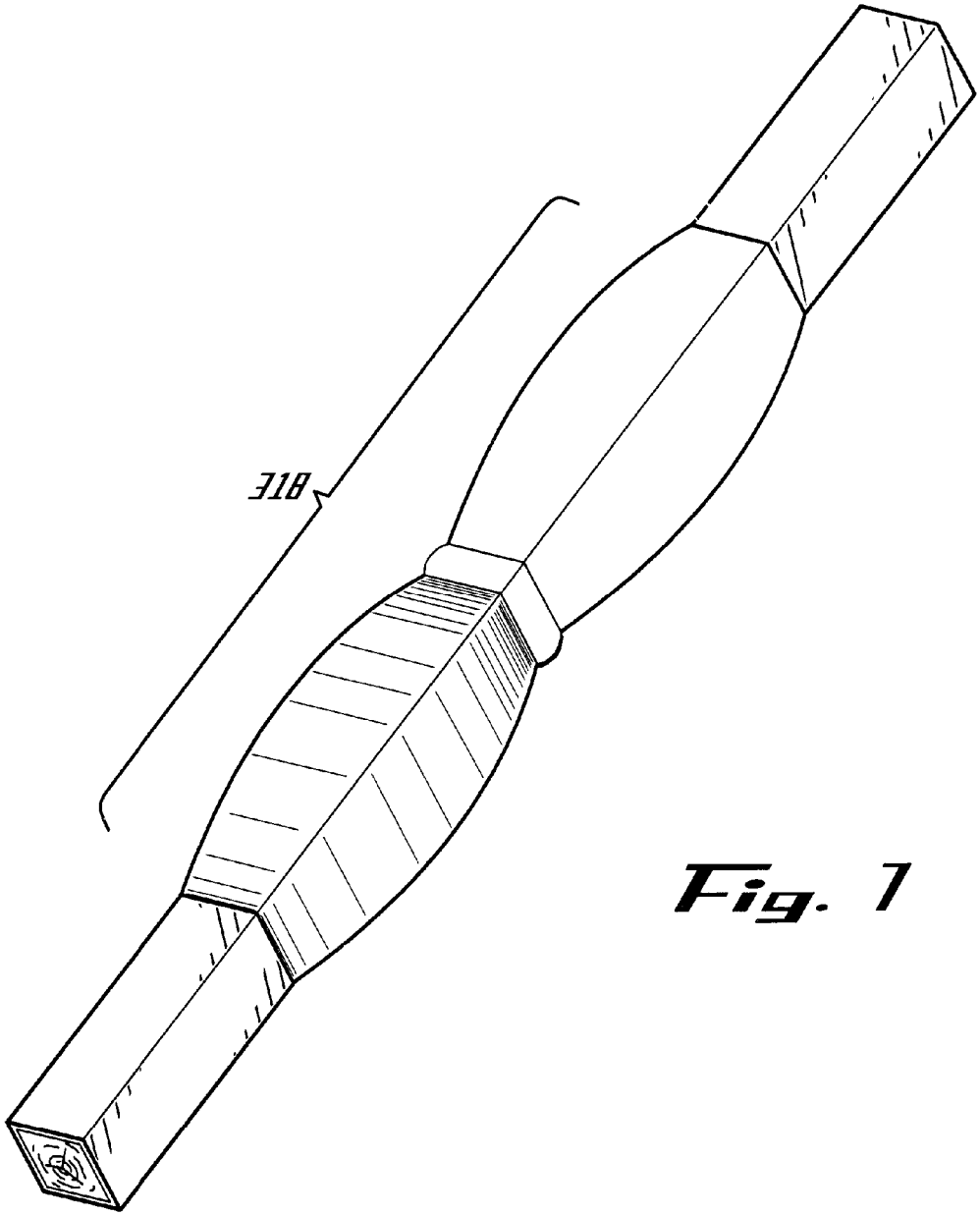

FIG. 6 is a side elevation view of the composite post according to a third form of the invention.

FIG. 7 is a prospective illustration of a composite post according to a fourth form of the invention.

DETAILED DESCRIPTION OF THE PREFERRED EMBODIMENTS

Figure 1:
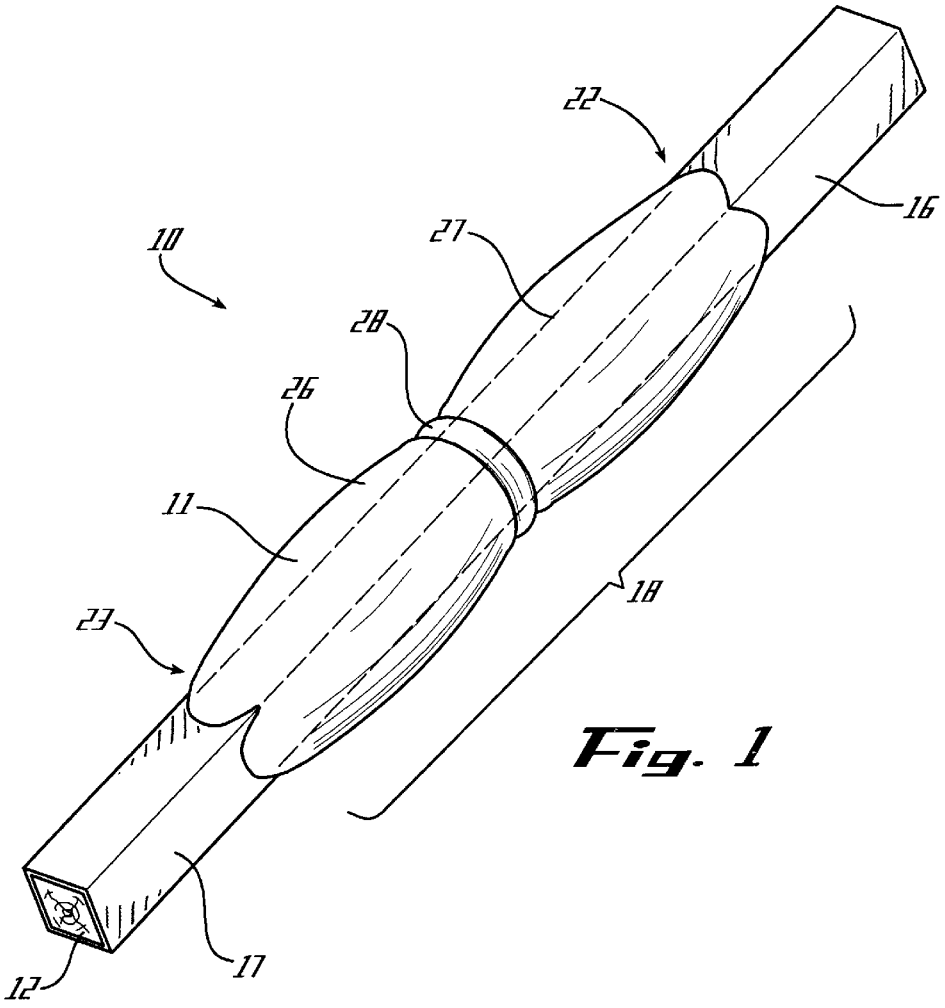
FIG. 1 is a perspective illustration of a composite post according to a first preferred form of the invention.

Referring now to the drawing figures, wherein like reference numerals depict like parts throughout the several views, FIGS. 1 and 2 show a composite post 10 according to a preferred form of the invention. The composite post 10 generally comprises a rigid plastic (typically PVC) outer shell 11 and a wood structural member 12 fitted within the PVC outer shell 11.

The PVC outer shell 11 includes a first end section 16, a second end section 17 opposite the first end section 16, and an intermediate section 18 between the first and second end sections. Each of the end sections 16, 17 is square in cross-section over substantially their entire lengths, with a transition region 22, 23 easing the transition between the square cross-section of the end sections 16, 17 and the "turned" profile of the intermediate section 18. In this regard, the overall visual effect of the post is that of a traditional, wooden post which, while initially square in cross-section along its entire length, is formed by turning it on a lathe to produce the rounded shapes in the intermediate section, such as the rounded shapes depicted in FIGS. 1 and 2.

In an exemplary commercial application of the invention, the composite post is sized to appear as a 6"×6" turned post. In such a configuration, the wood member 12 is a 4"×4" member about 44" long, with each end section 16, 17 being about 6" long. The end sections thus are readily attached, such as to joists, taking advantage of their flat sides. Optionally, one (or both) of the ends can be notched to facilitate attachment. The PVC outer shell or cladding 11 is about 0.150" thick and is blow molded in the middle section to achieve the expanded, decorative profile. The ends 16, 17 are snugly fitted about the wood reinforcing member 12.

For illustration purposes, FIGS. 1 and 2 depict an intermediate section having certain design elements common to turned wooden posts. For example, as depicted in FIGS. 1 and 2, the intermediate section includes two bulbous surfaces, 26, 27 and a smaller ring or collar positioned between the bulbous elements 26 and 27. Each of the bulbous elements 26 and 27 defines a surface of revolution, that is, a surface that is symmetrical at every cross-section location along the length of the post to provide the appearance of a wood post that has been "turned" on a lathe. Of course, other shapes are possible.

As can be seen in FIGS. 1 and 3, the size of the wood reinforcing element 12 is closely matched to the internal transverse dimension of the PVC outer shell end sections 16, 17. However, as shown in FIG. 4, the middle sections 26, 27 are at places radially separated from the reinforcing element 12 resulting in a gap between the middle sections and the reinforcing element. Because the reinforcing element 12 bears most or all of the load on the post 10, this gap 20 does not structurally weaken the composite post, but saves in plastic material used per post. Also, the thickness of the shell wall 21 then can be minimized along the length of the post.

As shown in FIGS. 5 and 6, the central section between the ends of the composite post can take various forms. As shown in FIG. 5, the central section 118 is asymmetric with numerous turned-like sections and rings. FIG. 6 shows another arrangement, albeit a symmetric one with central section 218 having a central-most non-turned section 19.

FIG. 7 shows another arrangement where the intermediate section only has the general appearance of a turned section. In this embodiment, the central section 318 is faceted, with four curvilinear facets. This has the result of maintaining a rectangular cross-section at any point along the length of the intermediate section 118. With this construction, the plastic shell is provided with increased strength.

The resulting composite post has the appearance of a turned wooden post as if it were made from a larger piece of lumber, without the attendant demand on timber resources for producing such. Moreover, the cost of manufacturing such a composite post is quite reasonable. Also, by the combination of the plastic outer shell and the wood reinforcing element, a strong, stiff post is achieved. The composite post constructed this way meets typical building code requirements for strength. Such building code requirement typically are not met by producing a hollow post of a similar shape made out of PVC, for example. This composite post is quite weather-resistant, owing to the external surfaces being made of PVC, while the less weatherable element (the wood) is concealed therewithin.

While the invention has been disclosed in preferred forms, it will be apparent to those skilled in the art that certain modifications, additions, and deletions can be made therein without departing from the spirit and scope of the invention as set forth in the appended claims. For example, other plastic materials can be used for the shell besides PVC. Also, the intermediate section or center section of the spindle can take various shapes, as desired. These and other modifications, nonetheless, fall within the scope of the invention as set forth in the following claims.

What is claimed is:

1. A composite post for use in construction, comprising:

a plastic outer shell having a first end section, a second end section opposite said first end section, and a middle section intermediate said first and second end sections, said middle section having at least one portion having an internal transverse dimension which is larger than an internal transverse dimension of each of said first and second end sections, said first and second end sections each having a substantially rectangular cross-section shape, a substantially same cross-section size, and a substantially same shell wall thickness; and an elongate wood reinforcing element disposed within said outer shell and extending from said first end section to said second end section but not extending out of said first end section or said second end section, said wood reinforcing element having a substantially rectangular cross-section shape conforming to the substantially rectangular cross-section shape of said first and second end sections, wherein at least a portion of said first and second end sections snugly surround portions of said wood reinforcing element so that said wood reinforcing element substantially fills said first and second end sections, and wherein at least a portion of said middle section is radially separated from said reinforcing element forming a gap therebetween.

2. A composite post as claimed in claim 1 wherein said shell has two open ends and said reinforcing element is exposed through said two open ends.

3. A composite post as claimed in claim 1 wherein said first and second end sections of said plastic outer shell each have a wall thickness that is less than a thickness of the reinforcing element.

4. A composite post as claimed in claim 1 wherein said middle section of said plastic outer shell is multi-faceted, but is rectangular in cross-section.

5. A composite post as claimed in claim 4 wherein said middle section of said plastic outer shell is square in cross-section.

6. A composite post as claimed in claim 1 wherein said middle section of said plastic outer shell is curvilinear and is circular in cross-section.

7. A composite post as claimed in claim 6 wherein said middle section has two bulbous sections having profiles that are symmetrical.

8. A composite post for building construction, comprising:

a plastic outer shell having first and second ends and a middle section therebetween, said first and second end sections each having a rectangular cross-section shape, a same cross-section size, and a same shell wall thickness, wherein said middle section is bulbous and extends radially outwardly beyond said rectangular first and second end sections; and a rigid reinforcing member having a rectangular cross-section shape conforming to the rectangular cross-section shape of said first and second end sections, positioned entirely within said plastic outer shell, extending from said first end section to said second end section, and substantially filling said first and second plastic end sections.

9. A composite post as claimed in claim 8 wherein said middle section comprises a curvilinear surface.

10. A composite post as claimed in claim 9 wherein said curvilinear surface is multi-faceted.

11. A composite post as claimed in claim 10 wherein said middle section has a rectangular cross-section.

12. A composite post as claimed in claim 8 wherein said curvilinear surface comprises a surface of revolution.

* * * * *